United States Patent [19]

VictorSchönfeld et al.

[11] Patent Number: 4,936,068

[45] Date of Patent: Jun. 26, 1990

[54] STRUCTURAL ELEMENTS AND ASSEMBLIES

[75] Inventors: Hans VictorSchönfeld, Hattorf; Ernst Hohrenk, Cremlingen, both of Fed. Rep. of Germany

[73] Assignee: Vereinigte Aluminum Werke AG, Bonn, Fed. Rep. of Germany; a part interest

[21] Appl. No.: 228,248

[22] Filed: Aug. 4, 1988

[30] Foreign Application Priority Data

Aug. 8, 1987 [DE] Fed. Rep. of Germany ..... 3726503

[51] Int. Cl.[5] ..... E04C 3/30

[52] U.S. Cl. ..... 52/282; 52/100; 52/280; 52/720; 52/732

[58] Field of Search ..... 52/280, 281, 282, 98, 52/100, 238.1, 239, 726, 732, 731, 720; 312/257 SK, 257 R; 403/171, 176, 292, 295, 298, 403

[56] References Cited

U.S. PATENT DOCUMENTS

| | | | |
|---|---|---|---|
| 208,326 | 9/1878 | Miner | 52/726 |
| 2,874,546 | 2/1959 | Fox | 52/726 |
| 3,706,169 | 12/1972 | Rensch | 52/732 |
| 3,730,389 | 2/1968 | Macaluso | 52/282 |
| 3,733,759 | 5/1973 | Schulte et al. | 52/282 |
| 3,768,222 | 10/1973 | Birum, Jr. | 52/282 |
| 4,036,371 | 7/1977 | Michel | 403/171 |
| 4,101,231 | 7/1978 | Streib | 52/282 |
| 4,187,649 | 2/1980 | Chaffee | 52/280 |
| 4,216,632 | 8/1980 | Mack | 52/732 |
| 4,388,786 | 6/1983 | Gassler | 52/238.1 |
| 4,410,157 | 10/1983 | Monti et al. | 52/726 |
| 4,429,502 | 2/1984 | Kinnebrew | 52/731 |
| 4,458,455 | 7/1984 | Tollstoff de Voss | 52/731 |

FOREIGN PATENT DOCUMENTS

| | | | |
|---|---|---|---|
| 922762 | 2/1955 | Fed. Rep. of Germany | 52/732 |
| 565952 | 8/1975 | Switzerland | 52/280 |

*Primary Examiner*—Michael Safavi

*Attorney, Agent, or Firm*—Perman & Green

[57] ABSTRACT

Tubular structural elements and assemblies comprising an outer tube and a concentric inner tube connected to each outer by ribs and having very high stability. Lengthwise recessed groove spaces are provided between the ribs, covered on the outside by removable strips or sectors of the outer tube and designed to receive flat structural elements. One or more of the groove spaces, which are sealed off by the strips or sectors of the outer tube, can be exposed by removal of the covering strips or sectors so that flat structural elements such as walls or facade panels, glass panes, or the like can be inserted where desired. The tubular structural element is sealable at the ends by end caps or sealing elements, or is connectable by axial or branched coupling parts with other tubular sections connectable at various angles, to erect halls, room partitions, pavilions, or the like.

4 Claims, 4 Drawing Sheets

STRUCTURAL ELEMENTS AND ASSEMBLIES

BACKGROUND OF THE INVENTION

1. Field of the Invention

The present invention relates to structural elements for use as columns or beams for constructing wall and/or ceiling elements or as free-standing posts and masts with high buckling strength.

2. Statement of Related Art

Many structural elements comprising panel-supporting posts or columns are generally known, for example, as disclosed in German Published Applications Nos. 17 84 527 and 19 20 525, said elements being provided with parallel ribs forming grooves between them. Structural elements such as boards, panels, glass panes, etc. can be inserted into these grooves at different angles to produce adjustable walls, room partitions, show booths, and furniture for stores and homes.

In structural elements of this type, sections are also known which have a tubular cross-section, as shown for example in German Patents Nos. 29 31 026 and 3141807, and German Published Application No. 29 41 008. These tubular sections have a definite advantage over other sections in that they have greater stability with less material, primarily with regard to buckling strength. Although such known tubular sections, having outwardly-directed projections or ribs, star shaped, and usually T-shaped in cross-section, make it possible to fasten walls and the like in nearly all desired directions, they do have disadvantages, for example as regards their supporting and carrying properties. Since they have free-standing, outwardly-directed ribs, such ribs can break off easily in the radial direction under mechanical force. The supporting property of these sections therefore is unsatisfactory and they cannot be used for posts and supports subjected to high static stresses without the danger of failure. In addition, the free-standing ribs project from the supporting surface and present a risk of injury, especially when they are used as corner posts. To reduce the risk of injury with these known sections, the grooves which are not engaged must be covered up or masked by costly means, for example additional rubber sections, which provide a smooth external seal but do not correct the static weakness of the sections.

Another disadvantage of these known sections is that because of their design they are not suitable for use as girders and are not intended for such use. Another disadvantage is that these known sections have a large surface open to the exterior, which can lead to corrosion of the section and has a negative effect on static behavior.

SUMMARY OF THE INVENTION

The present invention provides structural elements and assemblies of the aforementioned type but which are free of the disadvantages discussed above because they have recessed ribs and panel-supporting grooves. The novel structural elements of the present invention provide, with limited consumption of material, a very high buckling and bulging resistance when they are used as supports or columns, and an optimal carrying capacity when they are used as beams, with a positive connectability between each beam and each support being provided by a section having a high static load capacity.

A structural element having with these features permits its use as a post or support for halls, pavilions, and the like, said elements, in addition to their high-quality static properties, presenting completely closed surfaces which are smooth even when walls and/or glass panes are inserted; said surfaces are completely free of projections and therefore always remain clean, safe, and incapable of causing injury to passersby and users. Therefore, the structural elements of the present invention are especially advantageous when used for structures in public transit, for example for waiting rooms, as fence posts on streets and squares, pavilions, exhibition buildings, lighting masts, traffic signal masts, etc.

The invention will now be described in greater detail with respect to the embodiments shown in the perspective drawings.

DESCRIPTION OF THE PREFERRED EMBODIMENTS

Figure 1:
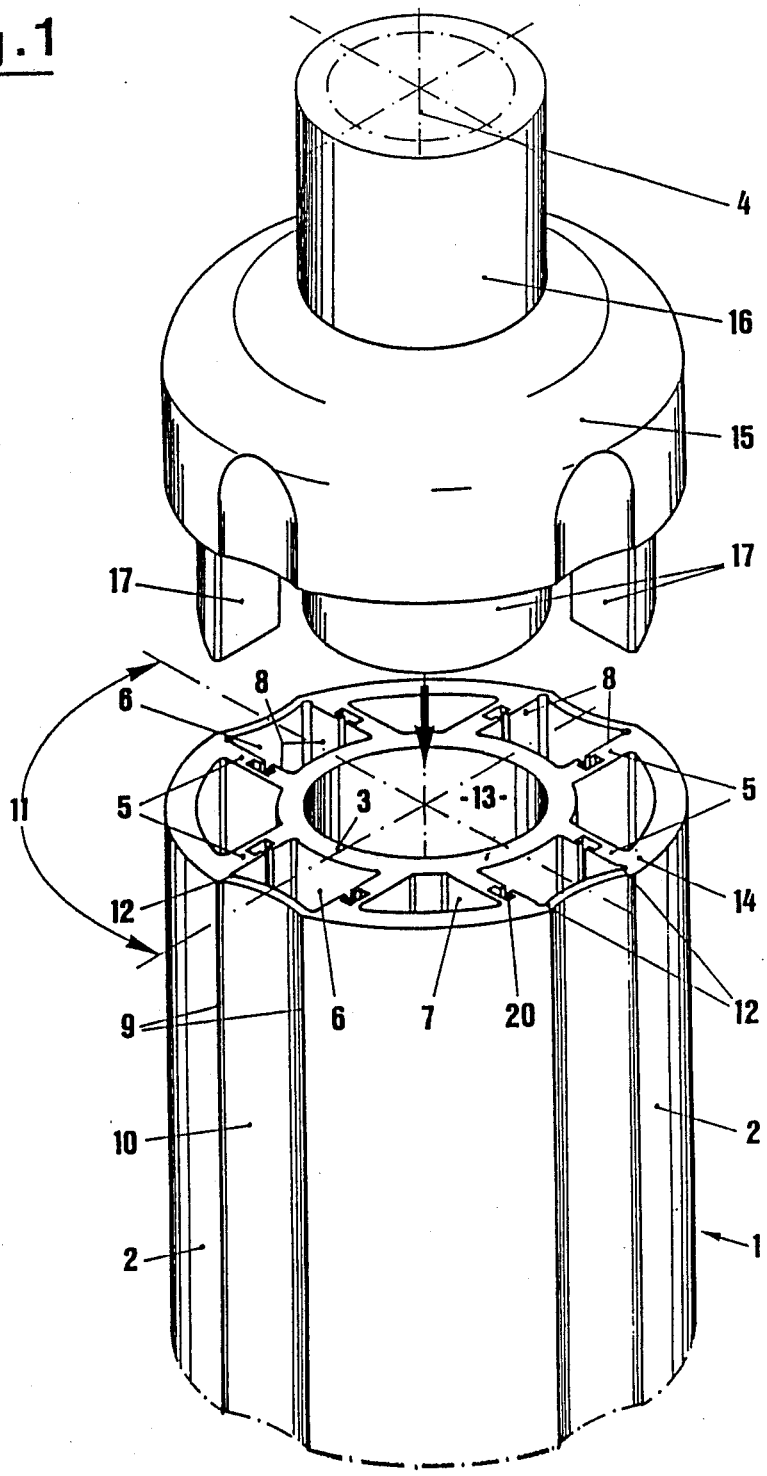
FIG. 1 is a perspective view of a structural element with a sealing element or end cap shown spaced thereabove, for purposes of illustration, in position to be moved down into positive engagement therewith to form an assembly, according to one embodiment of the present invention.

The structural element of FIG. 1 comprises a tubular section 1 consisting of an outer tube 2 and a concentric inner tube 3. Between inner tube 3 and outer tube 2, a plurality of elongate ribs 5 are provided, pointing approximately toward central axis 4. Between the ribs 5 alternate spaces 6, 7 are formed, running lengthwise of the tubular section 1. Spaces 6 open radially-outwardly from the inner tube at right angles to adjacent spaces 6, at an angle 11 in the cross section of tubular section 1, and form lengthwise recessed groove spaces 6, which are adapted to receive and fasten the edges of flat structural elements, as described in greater detail with respect to FIG. 2. The opposed lateral rib surfaces 8 of groove spaces 6 are aligned approximately parallel to one another in order to allow narrow, flat structural elements to be slid in, as for example glass panes, structural panels and the like, and to allow fastening means such as rubber sections to be inserted when necessary. Outer tube 2 is marked or scored externally along score lines 12 aligned with surfaces 8 delimiting edges 9 of the recessed groove spaces 6, after removal of the concave covering areas or outer tubular sectors 10, in order to facilitate removal of outer tubular sectors 10 of the outer tube 2 and uncover as many of the groove spaces 6 which are to be used to receive panels or panes in each particular assembly.

As shown in the drawing, outer tube sectors 10 are curved, i.e. inwardly concave. The inwardly curved surfaces of outer tubular sectors 10 produce a higher resistance to mechanical forces acting laterally on outer tube 2. This advantageous design also permits the sectors 10 to be made with thinner walls for ease of removal.

Weakening notches or score lines 12, running lengthwise, are provided at edges 9 of sector areas 10 to allow the recessed groove spaces 6 to be uncovered and exposed in simple fashion without any rough edges in areas where flat structural elements are to be inserted in tubular section 1. The curved sector surfaces 10 of outer tube 2 preferably are designed to be separable by applying a chisel to the inside of edge 9 of the border of the groove 12 and striking it sharply to cause the sector 10 to break away from the connecting adjacent areas of the outer tube 2.

When tubular section 1 is used as a mast or post, the upper end of tubular section 1 preferably is sealed by a plug-in sealing cap or element 15 to form an assembly, element 15 being provided with projections 17 which, when the sealing element 15 is placed on tubular section 1, enter at least some of spaces 6, 7 and 13. Sealing element 15 preferably is also provided with an axial connecting part 16, for example to receive and support any roof girder, railing, or the like. A sealing element 15 of this design rests positively on the entire cross-sectional surface 14 of tubular section 1, with an optimum flow of force through sealing element 15 to tubular section 1 when a stress is applied to connecting part 16. Connecting part 16 can have any design depending on the structural application. As shown in FIG. 1 of the drawing, for example, it can consist of an axial tubular pin or cylinder section with the diameter of the base portion being flush with space 13 of inner tube 3. This makes it possible to use the interior of hollow space 13 of tubular section 1 and the hollow interiors of sealing element 15 and of connecting part 16 advantageously, for example as a water drainage channel and/or to contain supply lines for energy, such as electric cables, or lines for liquid and gaseous media.

The sealing cap or element 15 of the drawings can be replaced with a connecting element for axially connecting an assembly containing two tubular sections 1. For this purpose, the connecting element is provided at the top and bottom surfaces with upward and downward pin-like projections, similar to projections 17 of sealing element 15, for engagement within the ends of a pair of tubular sections 1 to be connected in axial alignment.

Figure 2:
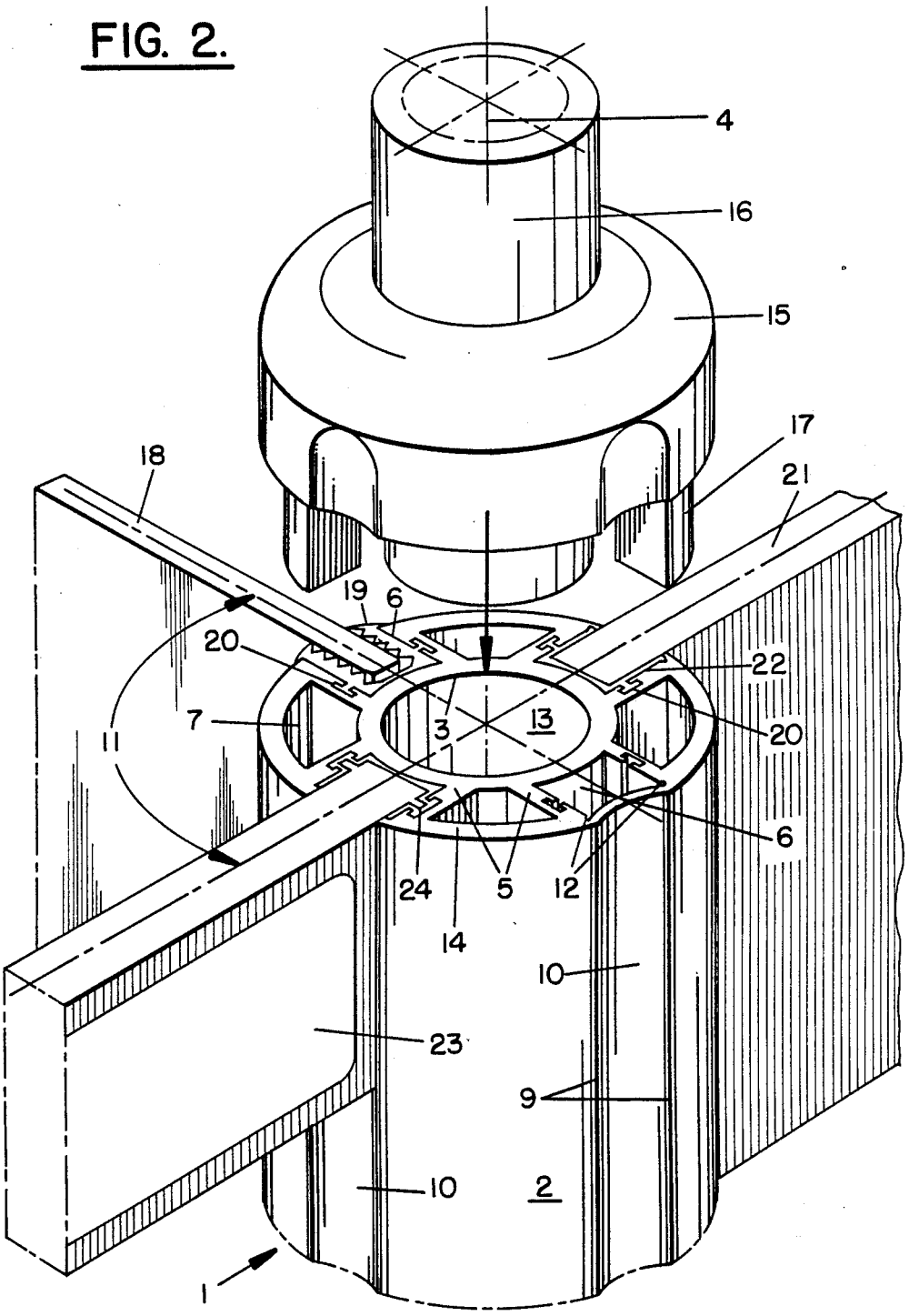
FIG. 2 is a perspective view of the structural element according to FIG. 1, with a plurality of flat structural elements such as panels and panes engaged therein.

FIG. 2 illustrates an assembly of a tubular section 1 with structural elements of different types inserted therein. When a thin glass pane 18 is to be inserted, the concave outer tubular sector 10 is first removed over a length corresponding to the specific dimensions of the glass pane 18. Then a cushion section 19, such as of rubber, is inserted into the exposed groove space 6. Preferably retainer recesses 20 are provided laterally in tubular section 1 in the opposed lateral surfaces 8 of groove spaces 6, into which the correspondingly-shaped rubber projection ribs 19 can be forced. The insertion of glass pane 18 into rubber section 19 is then performed in known fashion.

The edge of a flat structural element, for example, wall panel 21, can be inserted for nearly its complete width into recessed groove space 6 and then sealed and fastened with an adhesive 22 for example.

The fastening of other parts, for example, direction sign 23, shown in FIG. 2 can also be accomplished with devices mounted on the structural element, for example flexible bushings 24, which are insertable from above into recesses 20. After the end cap or sealing element 15 is put in place on tubular section, directional sign 23 is reliably fastened by forcing it into the groove for frictional engagement between the bushings 24.

Figure 3:
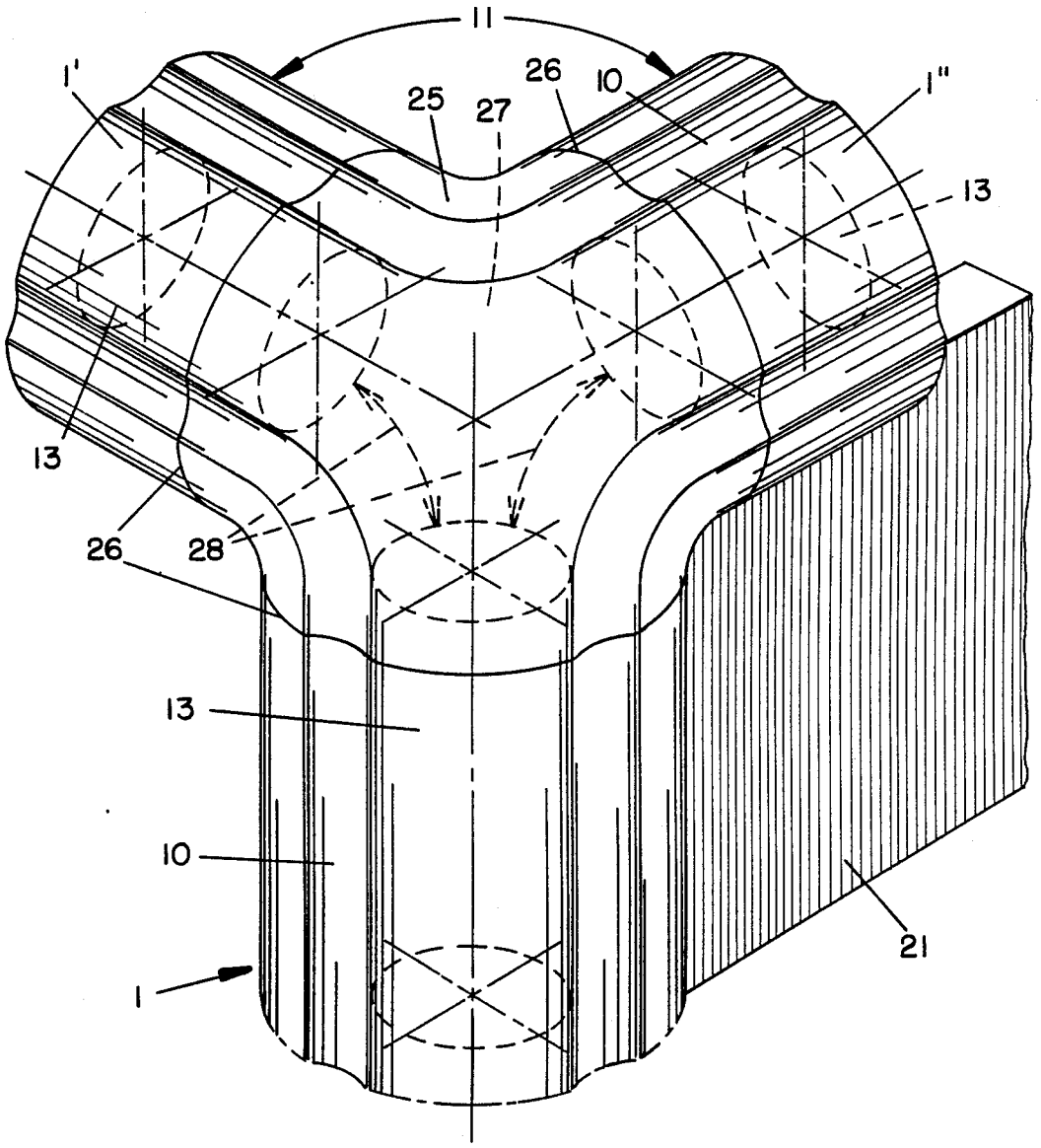
FIG. 3 is a perspective view of a structural element having a sealing coupler for providing branched connections between a plurality of structural elements as illustrated by FIGS. 1 and 2, for providing support and girder assemblies.

FIG. 3 shows another advantageous embodiment of the present invention, comprising an assembly including a branched coupling part 25. Coupling part 25 is formed on its connecting sides 26 in the same manner as connecting part 15, with outward peripheral projections similar to inward projections 17 of FIG. 2. In the form shown, coupling part 25 joins a vertical tubular section 1 as a support with two horizontal beams 1' and 1" arranged at right angles to each other and perpendicular to section 1. Coupling part 25 is provided with hollow spaces 27 so that supply or waste lines can be laid in the direction of arrow 28 and in all other directions to run completely through the supports and beams.

Coupling part 25 can be replaced by one having a transverse cross-section in the shape of a star or an X or a Y, for example, with three or more horizontally-extending branches having connecting ends 26, or at any other angles 11 to one another, for example at three angles 11 of 120° each. In addition, a coupling part 25 of this kind can also have an additional connecting end 26 in the vertical direction, axial relative to the connecting end 26 shown attached to the vertical tubular section 1 of FIG. 3, for attaching another vertical support 1 axially, for example for erecting a two-story pavilion or the like.

Between the supports and beams, structural elements such as wall panel 21 can be positively fitted on all sides into recessed grooves in sections 1' and 1" which are aligned with the similar recessed grooves 6 of tubular section 1 to form an extremely supportive and stable framework assembly as an orthotropic panel. Coupling parts 25 with only one branch are advantageously used for street lights and traffic lights.

Figure 4:
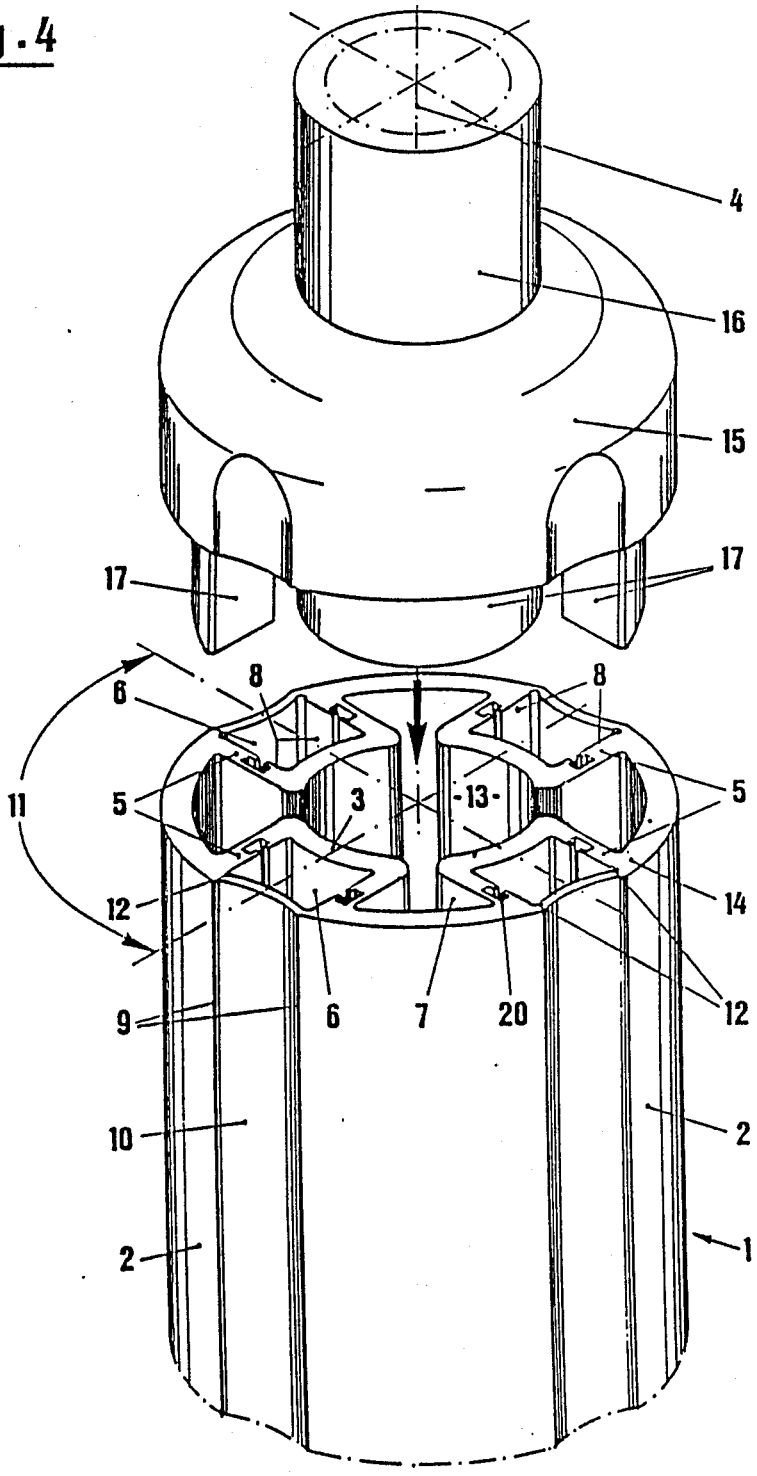
FIG. 4 is a perspective view of a structural element according to another embodiment of the invention, having an alternative design for the interior cavity.

FIG. 4 illustrates another alternative hollow space design for the tubular section 1, which is advantageous for reasons related to continuous casting, especially as regards tool design. In this case, space 13 of inner tube 3 is connected with projection-engaging spaces 7 while retaining the advantageous static properties provided by the inner tube 3 in section 1. Such a design facilitates the casting of the tubular section 1, such as from suitable materials including aluminum alloys.

Accordingly, this invention is not to be regarded as limited to the embodiments disclosed herein, but is to be limited as defined by the appended claims.

We claim:

1. A unitary elongate tubular structural element having high resistance to buckling and bowing, for use as a support, beam or post for the attachment of elongate flat structural panels having elongate, straight narrow edges, said element comprising concentric inner and outer elongate tubular sections, a plurality of elongate ribs connecting said inner and outer tubular sections, adjacent pairs of said ribs having lateral surfaces which are approximately parallel to each other and define therebetween a narrow elongate groove space extending lengthwise between said tubular sections and projecting radially outwardly from the outer surface of said inner tubular section to the inner surface of said outer tubular section, said outer tubular section having a continuous outer surface including integral covering areas which completely enclose each said groove space and which have an elongate concave surface which is curved inwardly of each said groove space, between the parallel lateral surfaces of each pair of said elongate ribs, to increase the buckling strength of the structural element, and each said covering area being removable in elongate strip form to uncover each said groove space to permit the insertion and frictional engagement of the elongate straight narrow edge of an elongate flat structural panel within each said uncovered groove space for engagement with the lateral surfaces of said ribs, said elongate tubular structural element retaining high buckling and bowing resistance during use in that the outer surface thereof remains continuous unless a said integral covering area is removed therefrom to uncover a groove space, in which event said groove space is adapted to supportingly- engage the edge of structural panel therewithin.

2. Structural element according to claim 1 in which the covering areas of the continuous outer surface of the outer tubular section overlying said groove spaces are provided with elongate indicia, aligned with each of the parallel lateral surfaces of each pair of elongate ribs defining each said groove space, to indicate the width of said covering areas to be removed in said elongate strip form.

3. Structural element according to claim 2 in which said elongate indicia comprise elongate notches which facilitate the removal of said covering areas in said elongate strip form.

4. Structural element according to claim 1 comprising a plurality of said groove spaces, each of which projects radially outwardly from said inner tubular section at an angle of approximately 90° relative to adjacent groove spaces.

* * * * *